US005762588A

United States Patent [19]

Chen

[11] Patent Number: 5,762,588

[45] Date of Patent: Jun. 9, 1998

[54] STATIONARY EXERCISER

[76] Inventor: Paul Chen, 5F., No. 31, Gan Tzou 2nd Street, Shi Tun Chu, Taichung, Taiwan

[21] Appl. No.: 895,741

[22] Filed: Jul. 17, 1997

[51] Int. Cl.[6] ..... A63B 69/16; A63B 22/04

[52] U.S. Cl. ..... 482/57; 482/70

[58] Field of Search ..... 482/51, 52, 53, 482/57, 60, 111, 70, 71, 79, 80, 148

[56] References Cited

U.S. PATENT DOCUMENTS

| | | | |
|---|---|---|---|
| 5,352,169 | 10/1994 | Eschenbach | 482/57 |
| 5,383,829 | 1/1995 | Miller | 482/57 |
| 5,423,729 | 6/1995 | Eschenbach | 482/70 |
| 5,518,473 | 5/1996 | Miller | 482/57 |
| 5,562,574 | 10/1996 | Miller | 482/52 |
| 5,577,985 | 11/1996 | Miller | 482/52 |
| 5,685,804 | 11/1997 | Whan-Tong et al. | 482/51 |

*Primary Examiner*—Stephen R. Crow

[57] ABSTRACT

An exerciser includes a pair of levers and a pair of cranks pivotally secured on a base and a pair of links pivotally coupled between the levers and the cranks. A pair of beams are slidably supported beside the links for supporting a pair of foot supports and are pivotally secured to the middle portions of the levers. The beams are pivotally secured to the lower portions of the levers for allowing the foot supports to move for a greater distance than that of the links. The beams may be adjusted relative to the levers for adjusting the moving stroke of the foot supports.

5 Claims, 3 Drawing Sheets

STATIONARY EXERCISER

BACKGROUND OF THE INVENTION

1. Field of the Invention

The present invention relates to an exerciser, and more particularly to a stationary exerciser.

2. Description of the Prior Art

Typical stationary exercisers comprise a pair of foot pedals each having one or more wheels rotatably or slidably engaged with one or more tracks for allowing the foot pedals to move both upward and downward and forward and backward movements. U.S. Pat. Nos. 5,352,169 to Eschenbach and 5,383,829 to Miller disclose this type of stationary exercisers. The tracks are stationarily disposed on the ground for supporting the wheels.

The present invention has arisen to provide a novel exercisers.

SUMMARY OF THE INVENTION

The primary objective of the present invention is to provide a stationary exerciser including a pair of foot supports that may be moved forward and rearward relative to a primary driving mechanism.

In accordance with one aspect of the invention, there is provided an exerciser comprising a base including a rear axle and a front axle, a pair of levers including an upper portion pivotally coupled to the front axle for allowing the levers to be swung about the front axle, a pair of cranks rotatably secured to the rear axle and each including a pivot rod adapted to be rotated about the rear axle, a pair of links including a front portion pivotally secured to the levers and including a rear portion pivotally coupled to the cranks, a pair of beams supported beside the links, a pair of foot supports secured on the beams respectively, and means for moving the foot supports and the beams relative to the links.

The levers each includes a middle portion and a lower portion, the front portions of the links each is pivotally secured to the middle portion of the lever at a pivot pin, the beams each includes a front portion pivotally secured to the lower portion of the lever at a pivot shaft, the pivot pins are disposed between the front axle and the pivot shaft for allowing the pivot shafts to swing for a greater amplitude than that of the pivot pins and for allowing the beams and the foot supports to move for a greater distance than that of the links.

The levers each includes a sleeve secured to the lower portion, the pivot shafts are pivotally secured to the sleeves.

The lower portions of the levers each includes at least two holes, the pivot shafts are adapted to be secured to either of the at least two holes for adjusting a distance between the pivot shaft and the pivot pin and for adjusting a moving stroke of the foot supports relative to the links respectively.

The pivot rods of the cranks each includes a pulley rotatably secured thereon, the beams each includes a rear portion slidably engaged on the pulley for allowing the beams to be moved relative to the links.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
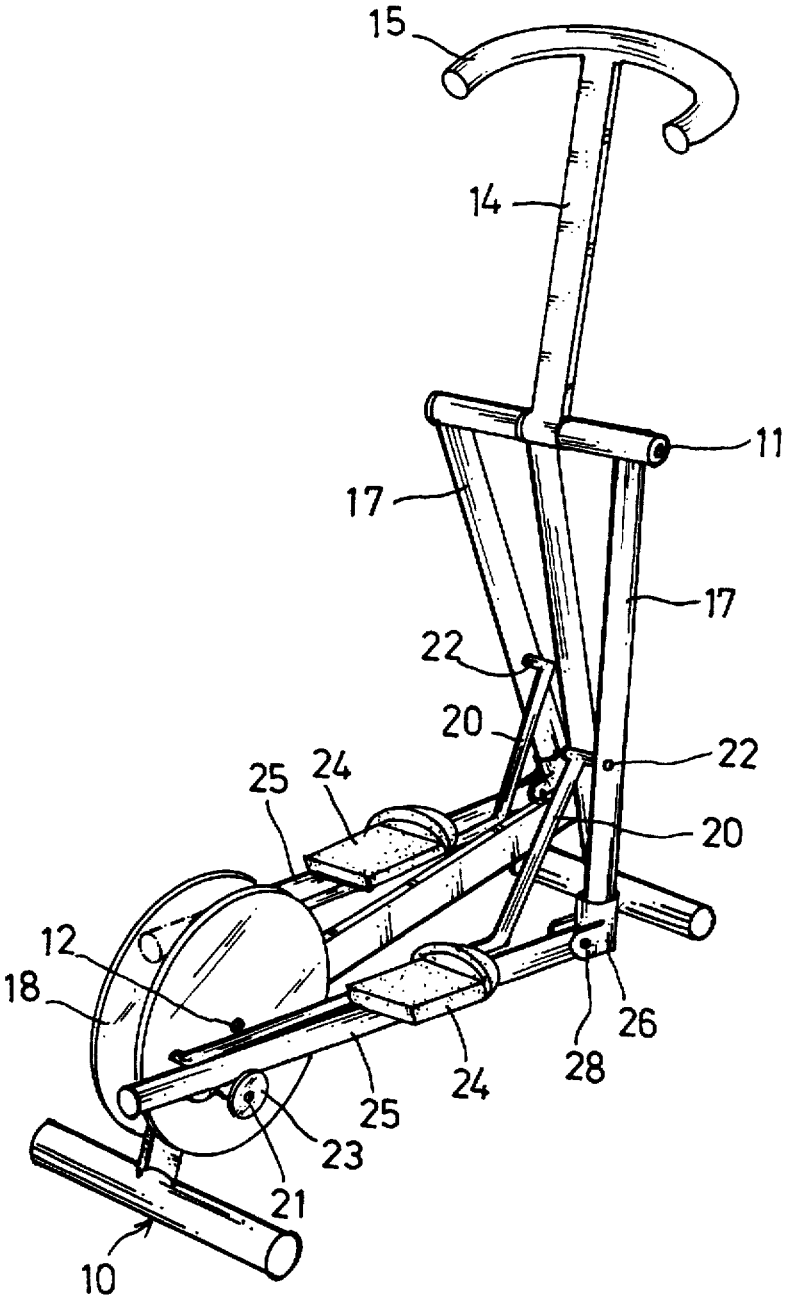
FIG. 1 is a perspective view of a stationary exerciser in accordance with the present invention.
Figure 3:
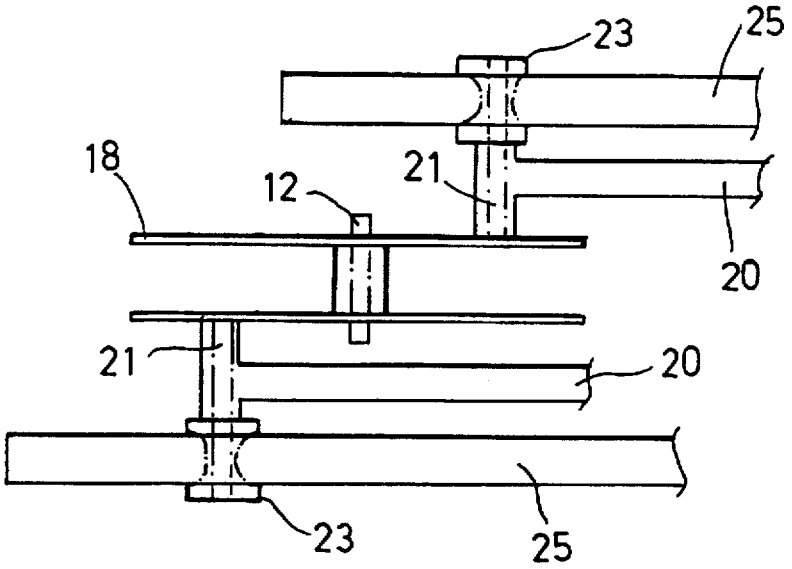
FIG. 3 is a partial top view of the exerciser.

Referring to the drawings, and initially to FIGS. 1–4, a stationary exerciser in accordance with the present invention comprises a base 10 including a front axle 11 and a rear axle 12, and including a post 14 extended upward from the front portion for supporting a handle 15 which may be used for supporting the upper portion of the user. A pair of levers 17 include an upper portion pivotally secured to the front axle 11 for allowing the levers 17 to be rotated about the front axle 11 respectively. A pair of wheels 18 are rotatably secured to the rear axle 12. A pair of pivot rods 21 are secured to the wheels 18 and formed as a pair of cranks 21 (FIG. 3) for allowing the cranks 21 to be rotated in concert with the wheels 18 and to be rotated about the rear axle 12. The pivot rods 21 each includes a pulley 23 rotatably secured on the pivot rods 21 respectively.

A pair of links 20 include a front portion pivotally secured to the middle portions of the levers 17 by pivot pins 22 and include a rear portion rotatably secured to the cranks 21 for allowing the rear portions of the links 20 to be rotated with the cranks 21 and for allowing the front portions of the links 20 to be swung with the levers 17. The distance between the crank 21 and the rear axle 12 may determine the moving stroke of the links 20; i.e., when the crank 21 is moved and secured to the radially outward portion relative to the rear axle 12, the moving stroke of the links 20 may be increased.

Figure 2:
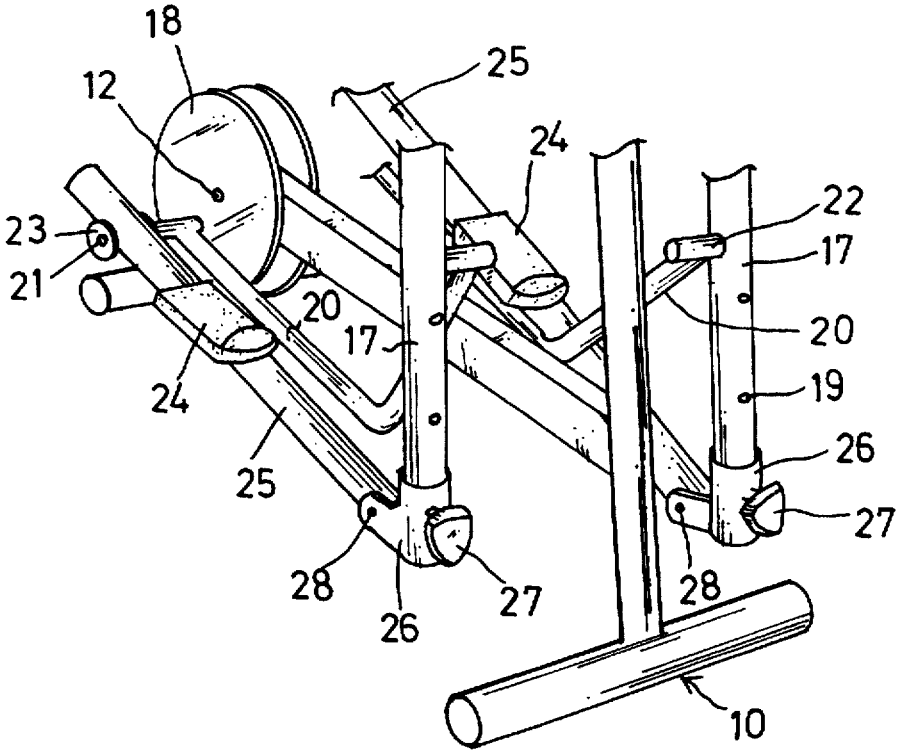
FIG. 2 is a partial front perspective view of the stationary exerciser.
Figure 4:
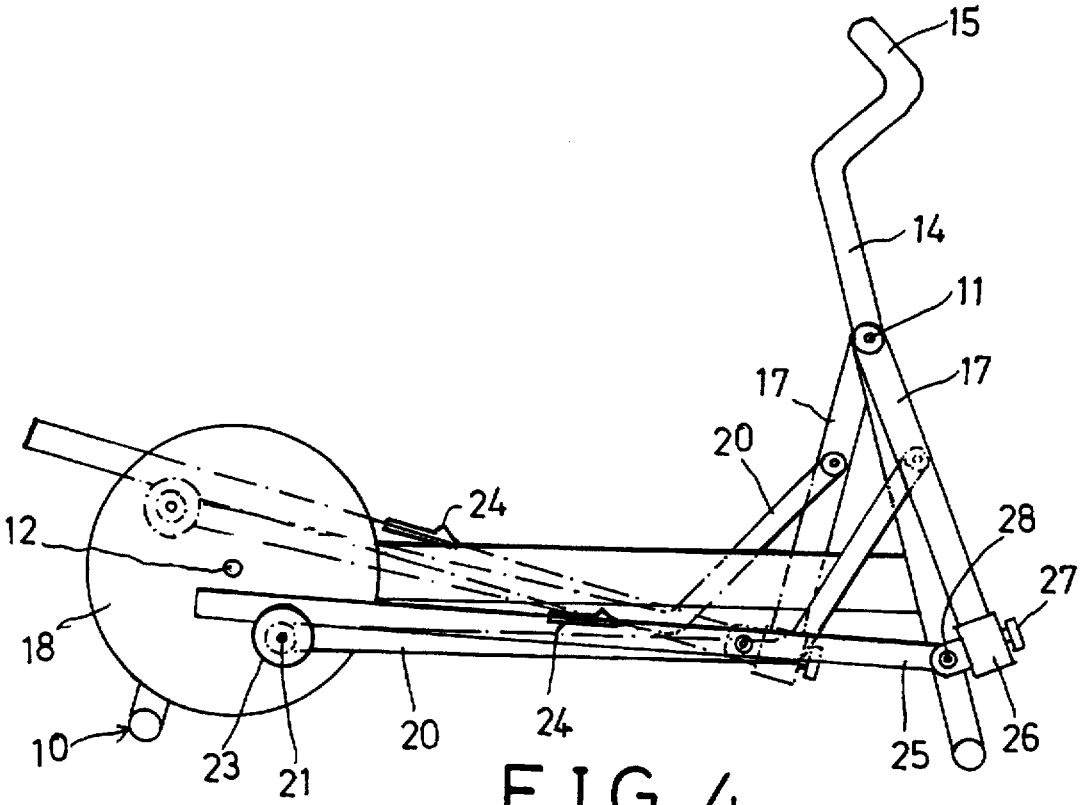
FIGS. 4 and 5 are side views illustrating the operation of the stationary exerciser.
Figure 5:
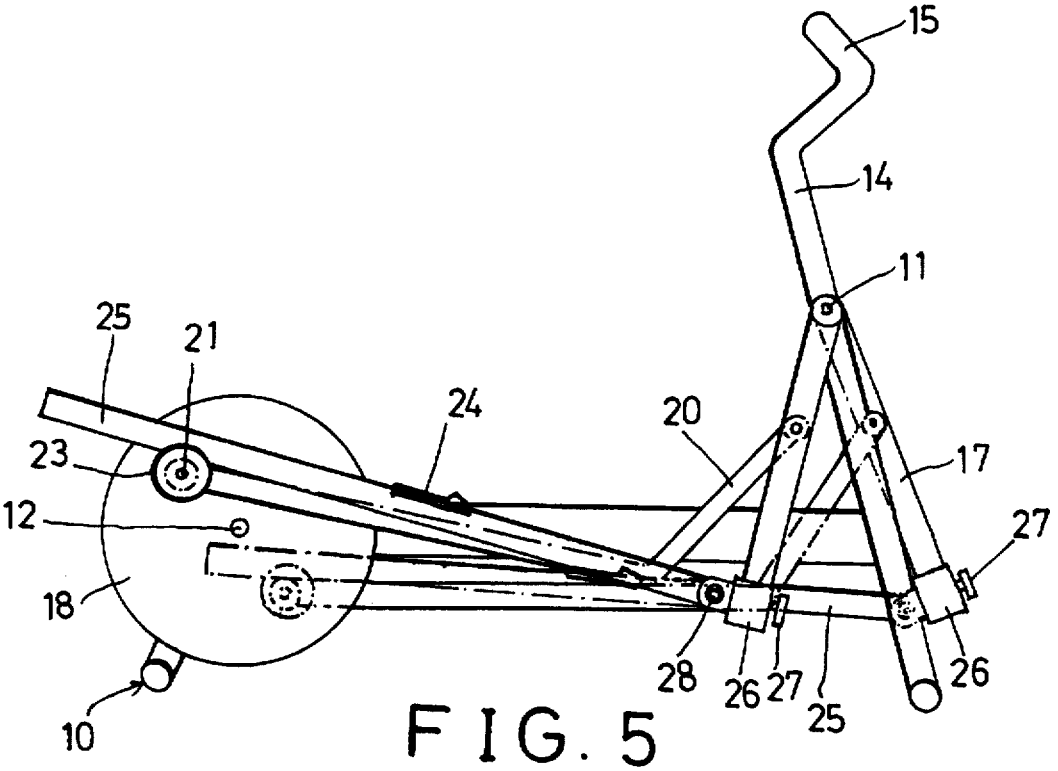

As best shown in FIG. 2, the lower portions of the levers 17 each includes a number of holes 19 and each includes a sleeve 26 slidably engaged thereon. Two fasteners 27 may secure the sleeves 26 to the levers 17 and may engage with either of the holes 19 for adjusting the distance between the pivot pins 22 and the sleeves 26. A pair of beams 25 each includes a front portion pivotally secured to the sleeves 26 at a pivot shaft 28 and each includes a rear portion slidably engaged and supported on the pulleys 23 (FIGS. 1, 4 and 5). Alternatively, the pivot shafts 28 may be directly secured to the levers 17 without the sleeves 26. A pair of foot supports 24 are secured on the beams 25 and moved in concert with the beams 25.

It is to be noted that the pivot pins 22 and the pivot shafts 28 move in concert with the levers 17 and rotate about the front axle 11. However, the pivot pins 22 are located closer to the front axle 11 than the pivot shafts 28, such that the swinging amplitude of the pivot shafts 28 is greater than that of the pivot pins 22 and such that the beams 25 move for a longer distance relative to the links 20. The adjustment of the pivot shafts 28 relative to the pivot pins 22 may adjust the relative movement between the beams 25 and the links 20. The relative movement between the foot supports 24 (which are supported on the beams 25) and the links 20 may thus be adjusted.

In operation, as shown in FIGS. 4 and 5, the rear ends of the links 20 and the pivot rods 21 may rotate about the rear axle 12, and the front ends of the links 20 may swing about the front axle 11, such that the links 20 may be moved along a substantially elliptical path. The beams 25 for supporting the foot supports 24 may be moved for a longer distance relative to the links 20 for forming an elliptical moving path other than that of the links 20. The slidable engagement between the rear portions of the beams 25 and the pulleys 23 allows the beams 25 to be relative to the pivot rods 21 which are rotated about the rear axle 12. The moving strokes of the foot supports 24 relative to the links 20 may be adjusted by adjusting the pivot shafts 28 along the levers 17.

Accordingly, the exerciser in accordance with the present invention includes a pair of foot supports that may be moved relative to the support links for allowing the user to conduct a stepping exercise along an elliptical moving path.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a rear axle and a front axle, a pair of levers including an upper portion pivotally coupled to said front axle for allowing said levers to be swung about said front axle, a pair of cranks rotatably secured to said rear axle and each including a pivot rod adapted to be rotated about said rear axle, a pair of links including a front portion pivotally secured to said levers and including a rear portion pivotally coupled to said cranks, a pair of beams supported beside said links, a pair of foot supports secured on said beams respectively, and means for moving said foot supports and said beams relative to said links.

2. An exerciser according to claim 1, wherein said levers each includes a middle portion and a lower portion, said front portions of said links each is pivotally secured to said middle portion of said lever at a pivot pin, said beams each includes a front portion pivotally secured to said lower portion of said lever at a pivot shaft, said pivot pins are disposed between said front axle and said pivot shaft for allowing said pivot shafts to swing for a greater amplitude than that of said pivot pins and for allowing said beams and said foot supports to move for a greater distance than that of said links.

3. An exerciser according to claim 2, wherein said levers each includes a sleeve secured to said lower portion, said pivot shafts are pivotally secured to said sleeves.

4. An exerciser according to claim 2, wherein said lower portions of said levers each includes at least two holes, said pivot shafts are adapted to be secured to either of said at least two holes for adjusting a distance between said pivot shaft and said pivot pin and for adjusting a moving stroke of said foot supports relative to said links respectively.

5. An exerciser according to claim 1, wherein said pivot rods of said cranks each includes a pulley rotatably secured thereon, said beams each includes a rear portion slidably engaged on said pulley for allowing said beams to be moved relative to said links.

* * * * *